US005303853A

United States Patent [19]

Nye

[11] Patent Number: 5,303,853

[45] Date of Patent: Apr. 19, 1994

[54] PRESSURIZED LIQUID DISPENSING CONTAINER AND VALVE

[76] Inventor: Norman H. Nye, 1348 Highbridge Rd., Cuyahoga Falls, Ohio 44223

[21] Appl. No.: 6,463

[22] Filed: Jan. 21, 1993

Related U.S. Application Data

[63] Continuation-in-part of Ser. No. 750,938, Aug. 28, 1991, abandoned.

[51] Int. Cl.[5] ..... B65D 37/00

[52] U.S. Cl. ..... 222/212; 222/105; 222/386.5; 222/518; 222/519

[58] Field of Search ..... 222/92, 105, 183, 212, 222/215, 386.5, 387, 518, 559

[56] References Cited

U.S. PATENT DOCUMENTS

| | | | |
|---|---|---|---|
| 1,356,837 | 10/1920 | Stegmaier | 222/559 |
| 2,554,293 | 5/1951 | Brown | 222/518 X |
| 2,570,422 | 10/1951 | Bashore | 222/559 |
| 2,685,978 | 8/1954 | Crockett | 222/518 X |
| 3,666,150 | 5/1972 | Liljeholm | 222/518 X |
| 3,782,603 | 1/1974 | McConnell et al. | 222/153 |
| 3,796,356 | 3/1974 | Venus, Jr. | 222/212 |
| 3,961,725 | 6/1976 | Clark | 222/212 X |
| 4,244,494 | 1/1981 | Colgate et al. | 222/386.5 X |
| 4,477,001 | 10/1984 | Galia | 222/402.1 |
| 4,687,123 | 8/1987 | Hyde | 222/518 |
| 4,739,906 | 4/1988 | LoTurco | 222/562 X |
| 5,083,681 | 1/1992 | Nye | 222/153 |

FOREIGN PATENT DOCUMENTS

| | | | |
|---|---|---|---|
| 0248755 | 12/1987 | European Pat. Off. | 222/212 |

*Primary Examiner*—Andres Kashnikow
*Assistant Examiner*—Joseph A. Kaufman
*Attorney, Agent, or Firm*—Oldham, Oldham & Wilson Co., L.P.A.

[57] ABSTRACT

Container assembly for dispsensing liquids under pressure comprising an upright container for liquid under pressure and having a vertical axis, an essentially cylinder valve body whose axis is transverse to that of the container, and a discharge nozzle which is coaxial with the valve body. The discharge nozzle has a front end wall and a frustoconical valve seat in the front end wall defining a fluid discharge opening that is larger at its outlet than at its inlet. A manually operable and axially movable male valve member which opens outwardly controls liquid discharges. The outer surfaces of the male valve member and the nozzle end wall on flush and devoid of recesses for ease of cleaning. A protective cap holds the valve closed.

9 Claims, 3 Drawing Sheets

PRESSURIZED LIQUID DISPENSING CONTAINER AND VALVE

CROSS REFERENCE TO RELATED APPLICATION

This application is a continuation-in-part of my copending application Ser. No. 07/750,938 filed Aug. 28, 1991, now abandoned.

BRIEF SUMMARY OF THE INVENTION

This invention is for a container assembly that is to be used for dispensing liquids by pressure and particularly for low pressure applications in which a liquid flow out to a container instead of being squirted or sprayed as is usual with the gas pressurized aerosol containers. This container assembly includes a container, a valve and discharge nozzle of very simple construction and has the advantage that after the dispensing operation, if the end of the discharge nozzle is wiped clean, there is no trapped liquid exposed to the atmosphere to become contaminated with dirt or bacteria. The valve is inexpensive to make and is handy to use.

DETAILED DESCRIPTION

Figure 5:
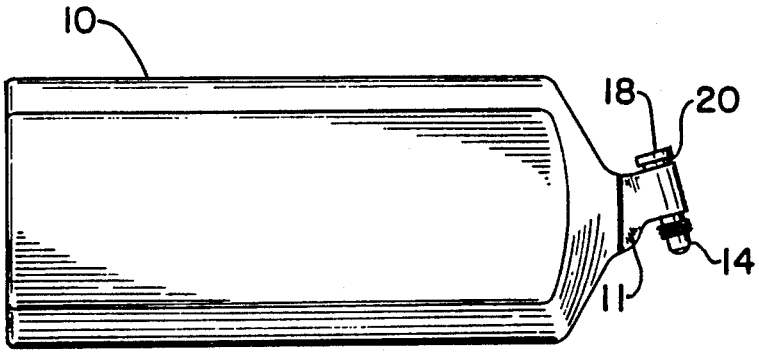
FIG. 5 is a much reduced view showing the valve applied for use in dispensing liquids from a large beverage container that is laid on its side for easy dispensing into a cup or drinking glass.
Figure 6:
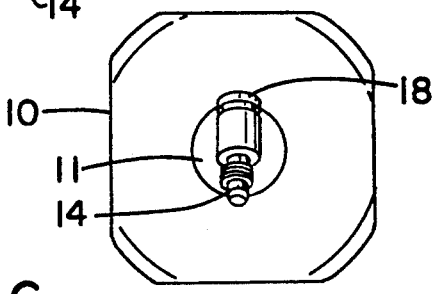
FIG. 6 is an end view of the large beverage container shown in FIG. 5.

Referring to the drawings, the container is composed of an outer shell 10 to which is attached a valve body 11 and a bottom metal stamped member 12. The shell 10 may be a piece of cylindrical tubing as shown in FIGS. 1, 2, 3 and 4, or it may be a large blow molded square housing as shown in FIGS. 5 and 6, or it can be any suitable enclosure. A cylindrical bore 13 is provided in the valve body 11 that has an axis that is transverse of the axis of the housing 10.

Figure 1A:
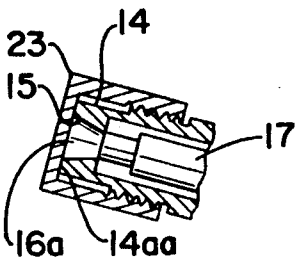
FIG. 1A is a fragmentary cross-sectional view of a container and valve according to a modified form of the invention.
Figure 1:
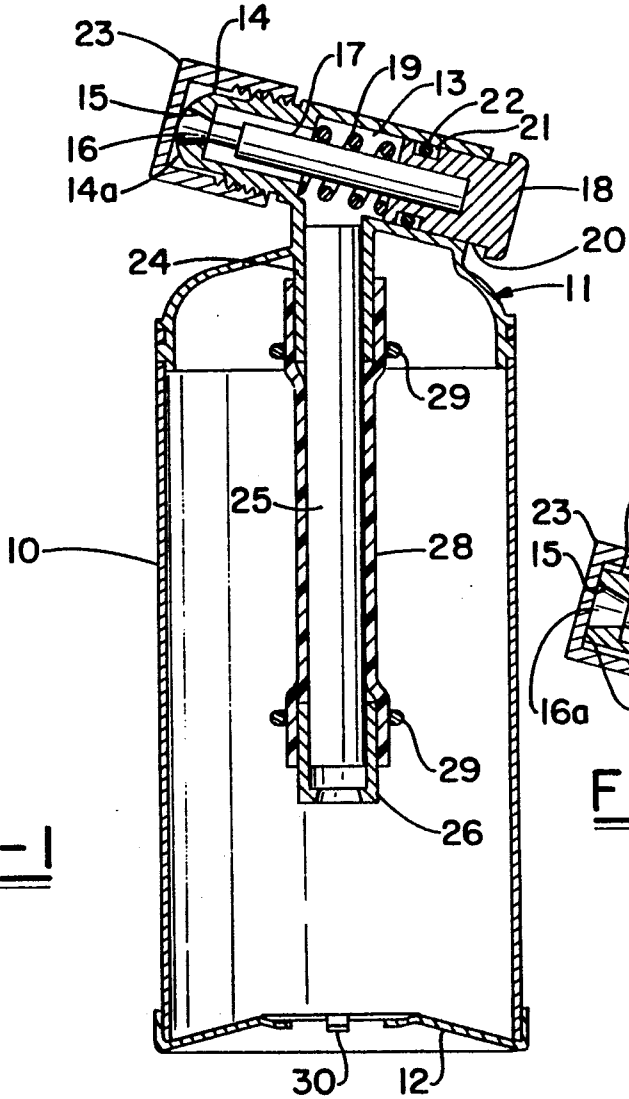
FIG. 1 is a somewhat enlarged cross-sectional view of a container and valve according to a first embodiment of the invention shown as manufactured and before i is filled with a liquid.

There is a discharge nozzle 14 that is integral with the valve body 11 and coaxial with bore 13. The discharge nozzle 14 is attached and connected to the pressurized dispensing container 10 through the valve body 11. Discharge nozzle 14 has an end wall **14*a* (FIGS. 1 and 2) at its outer or discharge end. This end wall 14*a* includes an inner surface (shown in FIG. 1) and an outer surface (shown in FIGS. 1 and 2); the outer surface of the end wall forms the outermost surface of the discharge end of discharge nozzle 14. The outer surface of the end wall 14*a* may be either slightly convex and spherically curved as shown in FIG. 1, or flat as shown in FIG. 1A (wherein the flat end wall is designated as 14*aa*. Extending through the end wall 14*a* or 14*aa* of discharge nozzle 14 is a frustoconical female valve seat 15 (i.e., a seat that has the shape of a frustum) with the largest diameter of the frustum being at the outermost end of the nozzle. The valve seat 15 defines and surrounds a fluid discharge opening or passageway extending through the end wall 14*a*. This opening has an inlet at the inner surface of end wall 14*a*, and an outlet at the outer surface of end wall 14*a***, and is of larger diameter at the outlet than at the inlet.

Figure 2:
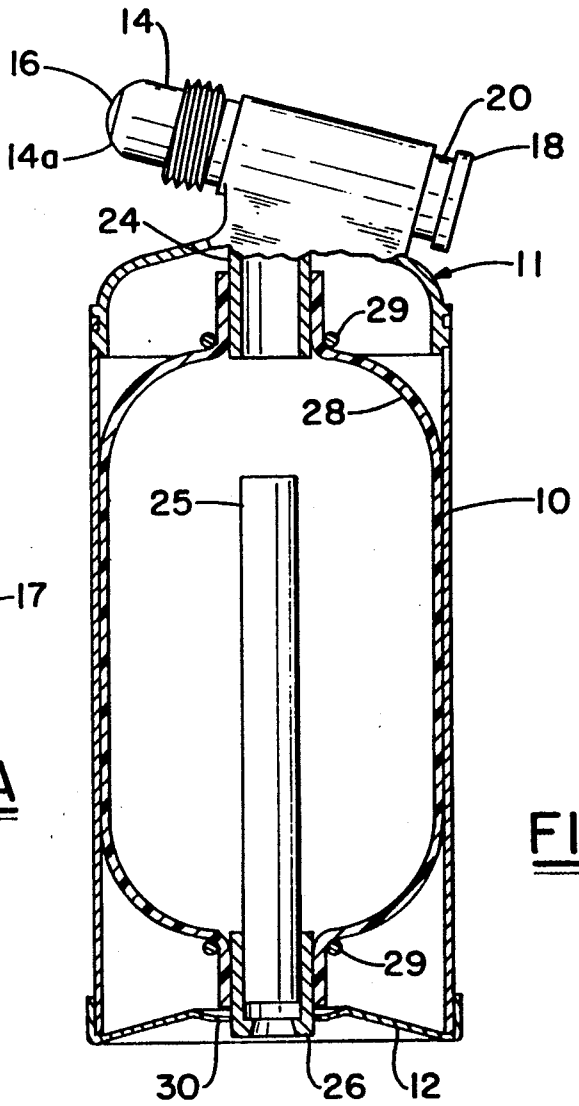
FIG. 2 is an enlarged partial cross-section of the container of FIG. 1 as it will be after filling with a liquid and after a protective cap has been removed so the liquid can be dispensed.

A male valve member (or valve head) 16 has a frustoconical or frustum shape to match and correspond to and thereby fit the valve seat 15. Male valve member 16 has an outer end surface, a frustoconical side wall which engages the valve seat 15 and has the same slope angle, and an inner end surface from which a valve stem 17 extends. Valve head 16 may be made of nylon or other material having at least a slight degree of flexibility or resiliency to assure fluid tight seating against the valve seat. The contour of the outer end surface of the male valve member 16 matches the contour of the outer surface of the discharge nozzle end wall **14*a* adjacent thereto. As shown in FIGS. 1 and 2, both may have an essentially spherical curvature with the same radius of curvature. Alternatively, as shown in FIG. 1A, both the nozzle end wall and 14*aa* and the outer end surface of the valve head 16*a* may be flat. The outer end surface of male valve member is smooth and flush with the adjacent outer surface of the end wall 14*a* of the discharge nozzle (which surface is the outermost surface at the discharge end of the nozzle 14 as previously noted). Ease of cleaning is promoted by making the two adjacent surfaces smooth and flush and of the same contour and curvature. Also, for ease of cleaning there are no recesses in either the outer surface of the wall 14*a* or the outer end surfaces of male valve member 16**. One can wipe these surfaces clean with a single stroke of a cloth or napkin.

A valve stem 17 is integral with the male valve member 16 and fits tightly into a manual operator which is preferably a push button 18. Push button 18 moves the male valve member 16 axially to its outward or open position. Biasing means for moving the male valve member 16 to inward or closed position, here shown as a valve spring 19, bears against a shoulder in the valve bore 13 and against the push button 18 so as to hold the male valve member 16 tightly against the valve seat 15 thereby holding the valve 16 closed to normally prevent discharge of the liquid in the container. A limited amount of movement is provided at 20 between the push button 18 and the valve body 11 so that manual pushing axially of the push button will open the valve. The push button 18 has a groove 21 into which is assembled an O ring 22. The O ring is provided to prevent leakage between the push button 18 and the bore 13. Normally, O rings are used for sealing sliding members and the groove for the O rings are made having a width of groove equal to about one and one half time the width of the O ring. The O rings fit tightly enough in the bore and the bottom of the groove so that there is some compression of the O ring and therefore normally some friction takes place when sliding occurs. In this design it is desirable that friction be eliminated as much as possible so that there is each operation of the valve and, since the axial motion of the push button 18 is very limited, the width of the groove is made extra wide so that the O ring only rolls and does not slide.

The valve body 11, discharge nozzle 14, male valve member 16 and push button 18 together form a valve assembly having first and second (or anterior and posterior) ends. End wall 14*a* of discharge nozzle 14 is at the first end of the valve assembly and push button 18 is at the second end of the valve assembly.

A protective cap 23 is threaded onto the outside of nozzle 14 and is arranged to bear against the male valve member 16 so that when the cap 23 is tightened in place the valve is held closed so as to prevent leakage even with rough handling. The male valve member 16 opens outwardly so that the protective cap 23 can hold the valve closed.

A tubular extension 24 is formed inside the valve body 11 into which is slidably fitted a rod 25. The interior of tubular extension 24 opens into bore 13 between the ends of the valve assembly. A bushing 26 is tightly press fitted into the lower end of rod 25. The bushing 26 has a frustum shaped hole in its lower end for receiving a stretching tool. An elastic tube 28 is provided that is pushed very tightly over the tubular extension 24 and the bushing 26. Metal rings 29 that are normally called hog ring staples can be added if needed to insure a tight non-slip fit of the elastic tube 28 onto the tubular extension and bushing 26.

The metal stamping 12 has prongs 30 that fit tightly on the outside of bushing 26 and are bent slightly so as to allow the bushing to be pulled through as shown on FIG. 2 but will dig in and resist the force exerted by the stretched tube 28. The elastic tube 28, when stretched and then filled, becomes a pouch to contain the liquid that is to be dispensed.

Figure 3:
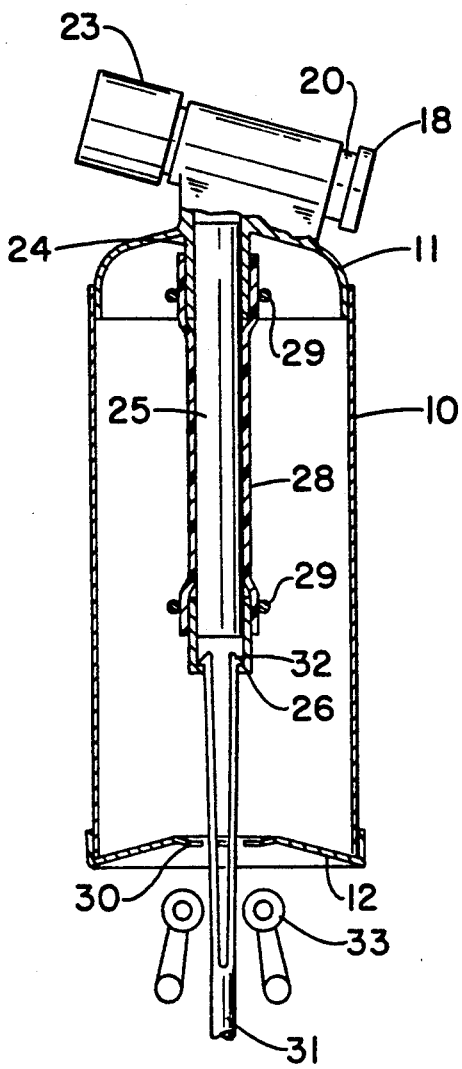
FIG. 3 is a partial cross-section of the container shown about normal size and that shows a method of stretching the inner elastic pouch.
Figure 4:
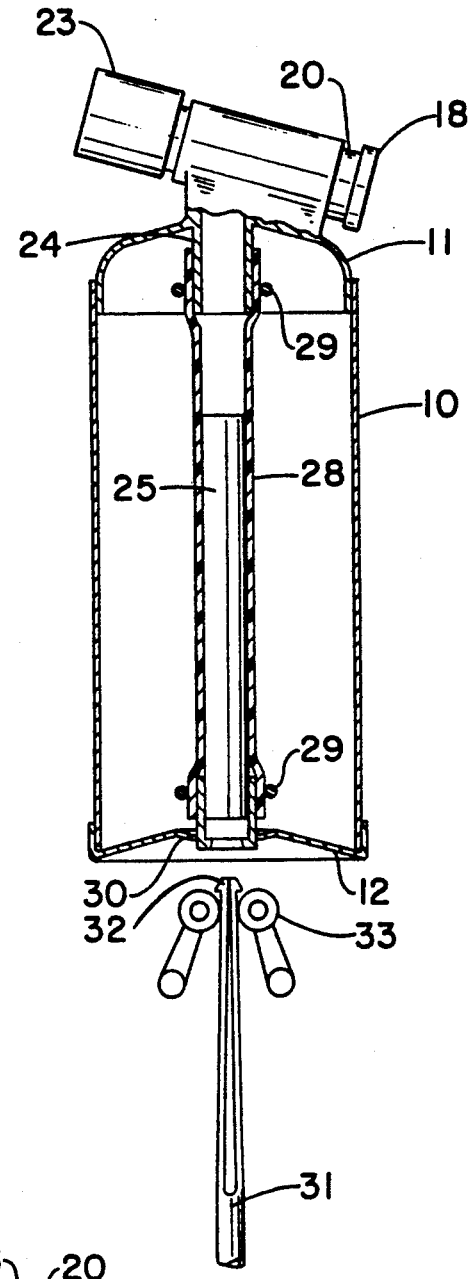
FIG. 4 is a partial cross-section of the container that illustrates the container after the inner elastic pouch is stretched.

Referring to FIG. 3, a rod 31 is provided with latches 32 that can enter bushing 26 and engage and pull it so as to stretch the elastic tube 28 to bring the bushing 26 through the metal stamping 12 and it then becomes locked in place by prongs 30 and a pair of release rollers 33 are brought together to unlatch the rod 31 and allow it to be retracted as shown in FIG. 4. After the stretching operation, the container is ready to be filled through the valve by connecting a filling device to the valve nozzle while holding the valve open by means of push button 18. FIGS. 5 and 6 show in reduced scale a large beverage container for which this design is particularly intended to be suitable.

The stretching operation of the elastic tube has two principal functions. It results in controlling the shape of the bottom of the elastic pouch to prevent wrinkling and unequal distortion of the walls of the elastic tube material, and the stretching also allows a large container to be laid on its side and will dispense nearly all of the liquid from the container instead of the pouch hanging down and trapping much of the contents.

Figure 8:
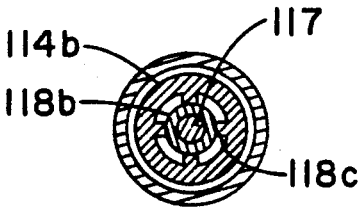
FIG. 8 is a cross-sectional view taken along line 8—8 of FIG. 7.
Figure 9:
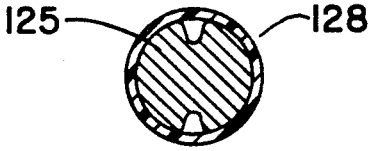
FIG. 9 is a cross-sectional view taken along line 9—9 of FIG. 7.

A second embodiment of the pressurized dispensing container assembly of this invention will now be described with reference to FIGS. 7–9.

Figure 7:
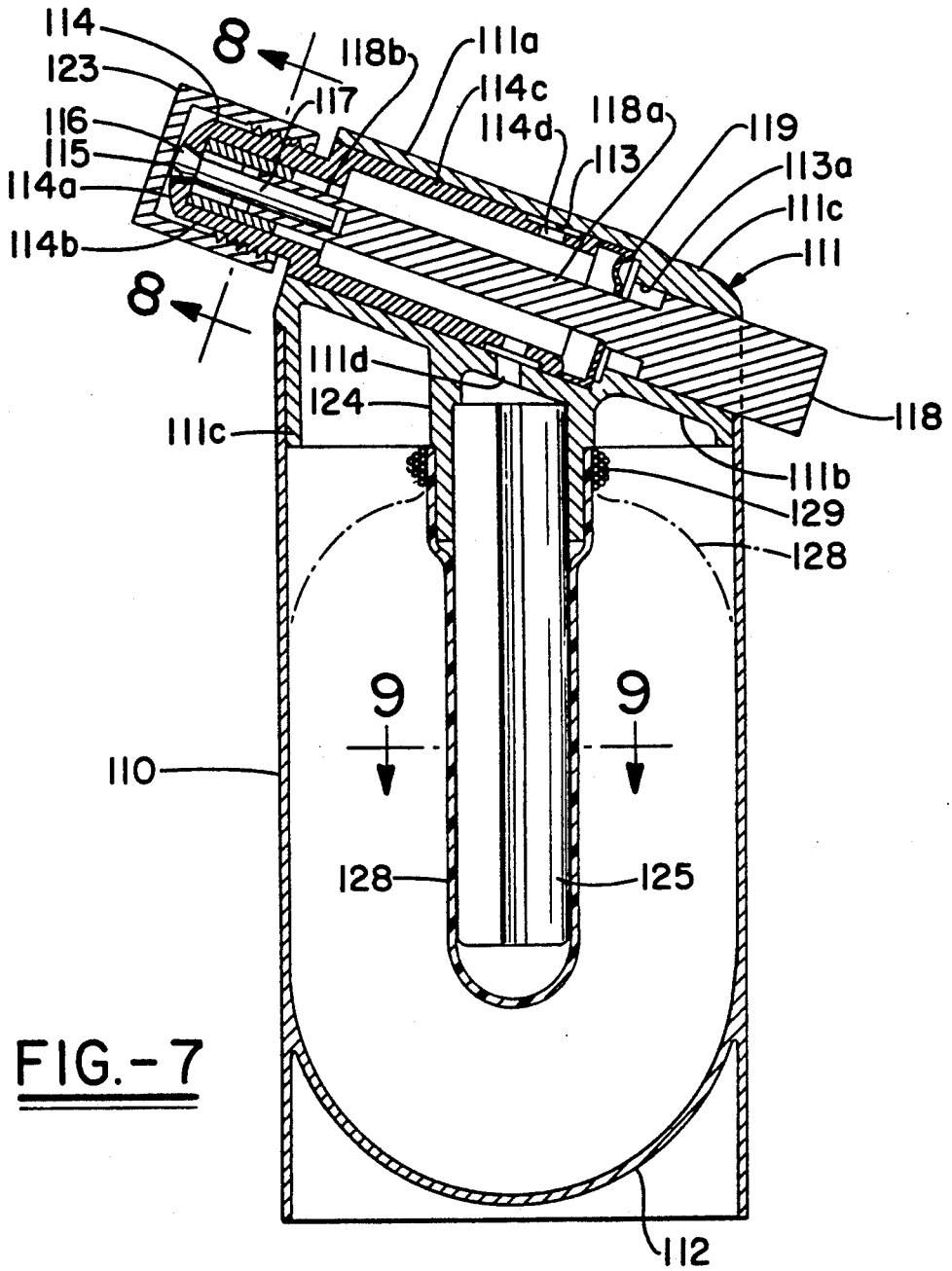
FIG. 7 is a cross-sectional view of a container and associated discharge nozzle and valve according to a second embodiment of this invention.

Referring particularly to FIG. 7, the container assembly of the second embodiment comprises a container which has an outer shell 110. The outer shell 110 may be of cylindrical cross-section with a hemispherical bottom wall 112 that is integral with the cylinder side wall. Alternatively, the bottom may be formed as shown in FIG. 1. Also, the cross-sectional shape of the container may be square as shown in FIG. 6 is desired. The container 110 in its normal position is vertical or upright, with a vertical central axis.

A valve body 111 is mounted above the container shell 110 and is attached thereto. Valve body 111 is a one piece body which comprises integral concentric cylindrical valve casing portion 111*a* and 111*b* which have a common central axis that is transverse to the central axis of container shell 110, and a domed portion 111*c* which with the casing (111*a*, 111*b*) forms the top container 110. A cylindrical bore 113 is provided in the first cylinder casing portion 111*a*, and a counterbore 113*a*, which is coaxial with and of slightly smaller diameter than bore 113, is provided in the second cylindrical casing portion 111*b*. The axis of bore 113 and counterbore 113*a* coincides the axis of casing members 111*a* and 111*b*. An opening 111*d* in the cylindrical casing 111*a* provides communication between the bore 113 and the interior of container 110.

There is a discharge nozzle 114 that is press fit inside valve body 111 in tight fitting relationship. Discharge nozzle 114 is coaxial with bore 113 and counterbore 113*a*. Discharge nozzle 114 comprises an end wall 114*a* at the discharge end, and successive cylindrical side wall portions 114*b* and 114*c* which extend rearwardly (i.e., opposite to the direction of fluid flow) from the discharge end. The second cylindrical section 114*c* is of larger diameter than the first cylindrical section 114*b* and fits inside the casing 111*a* of valve body 111 in tight fitting relationship. A lateral opening 114*d* in the side wall portion 114*c* communicates with the opening 111*d* in valve body casing 111*a* to provide communication between the interior of the container 110 and the interior of the valve body 111 and discharge nozzle 114.

The discharge nozzle 114 is coaxial with the bore 113 and the counterbore 113*a* of the valve body 111, and the axis of the discharge nozzle is transverse to the axis of the container 110. The end wall 114*a* of discharge nozzle 114 has an axially aligned discharge opening for dispensing of fluid which is contained in container 110. Surrounding and defining this discharge opening is a frustoconical valve seat 115 (i.e., a female valve seat in the shape of a frustum). The largest diameter of the discharge opening and of the frustum which forms valve seat 115 is at the outlet and of the opening, i.e., at the outermost end of the nozzle, which is at the outer surface of the nozzle end wall 114*a*.

A male valve member (or valve head) 116 has a frustoconical or frustum shape to match and correspond to and thereby fit the valve seat 115. The male valve member 116 may be similar or even identical to the male valve member 16 in the first embodiment, and in any case is preferably made of a material such as nylon which has some degree of flexibility or resiliency (to permit tight seating on valve seat 115) and includes an outer end surface whose curvature matches that of the outer surface of end wall 114*a*, and an inner surface from which a valve stem 117 extends, in addition to the frustoconical surface which matches that of the valve seat 115. The valve head as formed or manufactured has this shape. The outer end surface of the of this male valve member 116 and the outermost surface at the end of the nozzle 114 (i.e., the outer surface of nozzle and wall 114*a*) has the same curvature (both are preferably slightly spherically and convexly curved) and are smooth and flush when the valve member 116 is in closed position so as to facilitate easy cleaning. Both the outer surface of end wall 114*a* and the outer end surface of male valve member 116 are devoid of recesses. These matching outer surfaces can be easily cleaned with a single swipe of a cloth or napkin.

The male valve member 116 and the female valve seat 115 together form a valve which controls discharge of fluid from the container 110.

Valve member 116 is axially moveable from an inward position (shown in FIG. 7) in which the valve is closed, to an outward position in which the valve is open to permit discharge of fluid.

A valve stem 117 is integral with the male valve member 116 and fits tightly into a manual operator which is preferably a push button 118 as shown. The push button 118 at one end (the end remote from the discharge end of discharge nozzle 114) is of essentially the same diameter as the counterbore 113*a* of valve body 111 so as to permit sliding movement therein. A push button stem, which is coaxial and integral with the push button 118 but of smaller diameter, extends forwardly from the push button 118 toward the discharge end of nozzle 114. The push button stem includes a solid portion 118*a* and (at the end remote from the push button 118) a hollow portion 118*b*. The two stem portions 118*a* and 118*b* are of the same outside diameter. The hollow stem portion 118*b* receives the valve stem 117 in tight fitting relationship, so that the male valve member 116, the valve stem 117 and the push button 118 move axially as a unit. Manual pushing of the button 118 in the axial direction will open the valve.

A plurality of longitudinal extending guide fins 118*a* (best seen in FIG. 8), which project inwardly from the end wall 114*a* of discharge nozzle 114, guide the axial movement of male valve member 116, stem 117, and push button stem portion 118*b*.

A diaphragm 119 is provided near the second or posterior end of valve body 111 (an remote from the discharge nozzle 114) in bore 113 to bias the valve member 116 to closed position. This diaphragm may be either straight (i.e., flat) or curved. Pressure from the contents of the container which is exerted on one side of the diaphragm (the side to the left as shown in FIG. 7) biases the valve 116 to closed position (the opposite side of diaphragm 119 is exposed to atmospheric pressure).

Diaphragm 119 is integrally joined to the stem portion of push button 118 in fluid tight relationship and is also attached to the bore 113 of valve body 111 in fluid tight relationship.

The valve body 111, discharge nozzle 114 male valve member 116 and push button 118 together form a valve assembly having first and second (or anterior and posterior) ends. End wall 114*a* of discharge nozzle 114 is at the first end and push button 118 is at the second end.

A protective cap 123 is threaded onto the outside of nozzle 114 and is arranged to bear against the male valve member 116 so that when the cap is tightened in place the valve is held closed so as to prevent leakage even with rough handling. The male valve member 116 opens outwardly so that the protective cap 123 can hold the valve closed.

A tubular extension 124 is formed inside the valve body 111 and depends from the cylindrical casing 111*a* of the valve body. The interior of extension 124 opens into bore 113 through openings 111*d* and 114*d*. A rod 125 is press fitted inside this extension 124. The cross-sectional shape of this rod 125 is best seen in FIG. 9.

An elastic tube 128, which is elongated, pen at one end (the top) and closed at the other end (the bottom), fits tightly over the tubular extension 124 and the cylindrical rod 125. This elastic tube may be made of rubber or plastic. This tube 128, when stretched and filled as shown by dotted lines in FIG. 7, becomes a pouch to contain the liquid that is to be dispensed. As this liquid is dispensed, the tube 128 gradually deflates and when fully deflated, assumes a solid line position against the rod 125 as shown in FIG. 7.

The tube 128 of this embodiment may be filled with a liquid to be dispensed in a manner similar to that used to fill the tube 28 of the first embodiment, i.e., through the discharge nozzle 114 and the valve.

The upper or open end of tube 128 is tightly held against the busing 124 by suitable means, such as a rubber thread 129 which is wound under tension around the top end of tube 128. The rubber thread when wound is locked with an adhesive.

While certain details of construction of the second embodiment differ from those of the first embodiment, as may be appreciated from the foregoing description. it will be apparent that the two embodiments are similar in construction and operation.

While the valve structures of the two illustrated embodiments herein are particularly useful in a non-aerosol dispensing container, as illustrated in both embodiments described in detail, it will be apparent that this valve structure can also be used for the dispensing structure of a conventional aerosol container. Other modifications can be made which do not depart from the scope and spirit of the appended claims.

What is claimed is:

1. A pressurized dispensing container assembly comprising a container having a nozzle attached and connected thereto for directing discharge of fluid from said container;

said nozzle having a discharge end, an annular side wall extending axially rearwardly from said discharge end, and an end wall extending radially inwardly from said side wall at said discharge end, said end wall having an inner surface, an outer surface which forms the outermost surface at said discharge end of said nozzle, said outer surface being outwardly convex or flat, and a frustoconical valve seat surface defining a central discharge opening extending axially through said end wall, said discharge opening have an inlet at said inner surface of said end wall and an outlet at said outer surface of said end wall and being of larger diameter at said outlet than at said inlet;

a valve at said discharge end comprising said valve seat and an axially moveable valve head, said valve head being of frustoconical shape and having an outer end surface and a frustoconical surface which matches the shape of the valve seat surface, said valve member being capable of fluid tight seating on said valve seat surface;

said outer end surface of said valve head and said outer surface of said end wall having the same curvature and being flush when said valve head is in closed position, and said outer surface of said end wall of said nozzle and said outer end surface of said valve member being devoid of recesses and being smooth, so as to facilitate easy cleaning;

means for causing relative axial movement between said valve head member and said valve seat surface to open and close said valve, said valve head opening axially outwardly so that said valve head has an inward position in which the valve is closed and an outward position in which the valve is open;

said valve head having essentially the same shape both as formed and in said closed position;

said pressurized dispensing container assembly further including a protective cap that contacts said valve head when said valve is closed and holds it tightly against the valve seat to prevent leakage of the contents of the container when said cap is in place.

2. A pressurized dispensing container assembly according to claim 1 in which said means for causing relative axial movement between said valve head and said valve seat surface comprises a manual operator for moving said valve head to open position, said container assembly further including biasing means for moving said valve head to closed position.

3. A pressurized dispensing container according to claim 1 wherein said outer surface of said end wall and said outer end surface of said valve head are outwardly convex and spherical and have the same radius of curvatures.

4. A pressurized liquid dispensing container and valve assembly comprising:

(a) an essentially upright container under pressure a liquid to be dispensed, said container having an upper end and an essentially vertical central axis;

(b) a discharge valve assembly above the upper end of said container for controlling the discharge of said liquid from said container, said valve assembly comprising:

(1) an essentially cylindrical hollow valve body having a central bore and a central axis which is transverse to the central axis of said container, said valve body having first and second ends and an opening between said ends which provides communication between said container and the bore of said valve body;

(2) a discharge nozzle at said first end of said valve body, said discharge nozzle being coaxial with said valve body and including a transversely extending end wall having an inner surface and an outer surface, a central discharge opening extending axially through said end wall, and a frustoconical valve seat surrounding said discharge opening, said frustoconical valve seat having an inlet end and an outlet end, the outlet end being of larger diameter than the inlet end, said outer surface of said end wall being outwardly convex or flat;

(3) a frustoconical valve head for seating on said valve seat and an essentially cylindrical valve stem connected to said valve head, said valve head being capable of fluid tight seating on said valve seat, the valve head being of frustoconical shape to correspond to and fit the valve seat and having an outer surface which has the same curvature as that of the outer end surface of said end wall, said valve stem being disposed inside said valve body and extending longitudinally along the axis of said valve body, said valve head and valve stem being axially moveable between an inward seating position and an outward position in which said valve is open so as to permit discharge of said liquid from said container;

said outer end surface of said valve head and said outer surface of said end wall being flush when said valve member is in closed position so as to facilitate easy cleaning;

said valve head having essentially the same shape both as formed and in said closed position;

(4) biasing means for biasing said valve head and valve stem toward seating position;

(5) a manual operator at the first end of said valve body for moving said valve head to open position; and (6) sealing means between said valve body and said manual operator for preventing the escape of fluid to be dispensed; wherein the outer end of the valve head and the outer surface of the discharge nozzle adjacent to the valve seat are flush and are devoid of recesses for ease of cleaning, and (c) a protective cap that contacts said valve head and holds it tightly against the valve seat to prevent leakage of the contents of the container when said cap is in place.

5. A dispensing container and valve assembly according to claim 4 wherein said container contains an elastic tube for containing the liquid to be dispensed.

6. A dispensing container and valve assembly according to claim 4 wherein said manual operator is a push button connected to the valve stem so that pushing on the push button opens the valve.

7. A dispensing container and valve assembly according to claim 6 wherein said sealing means is an O ring and said push button contains a groove for said O ring, said groove being wide enough so that rolling of the O ring takes place without sliding.

8. A dispensing container and valve assembly according to claim 4 wherein said biasing means is a spring.

9. A dispensing container and valve assembly according to claim 4 wherein said container contains under pressure the sole liquid to be dispensed.

* * * * *